US008645046B2

(12) United States Patent
Kawakatsu

(10) Patent No.: US 8,645,046 B2
(45) Date of Patent: Feb. 4, 2014

(54) CONTROLLER FOR INTERNAL COMBUSTION ENGINE

(75) Inventor: Yasuhiro Kawakatsu, Karyia (JP)

(73) Assignee: Denso Corporation, Kariya (JP)

( * ) Notice: Subject to any disclaimer, the term of this patent is extended or adjusted under 35 U.S.C. 154(b) by 126 days.

(21) Appl. No.: 13/439,194

(22) Filed: Apr. 4, 2012

(65) Prior Publication Data

US 2012/0255532 A1 Oct. 11, 2012

(30) Foreign Application Priority Data

Apr. 7, 2011 (JP) ..... 2011-085045

(51) Int. Cl.
*F02D 41/14* (2006.01)

(52) U.S. Cl.
USPC ..... 701/104; 701/109; 123/673; 73/114.72

(58) Field of Classification Search
USPC ..... 701/104, 109; 123/673; 73/114.72
See application file for complete search history.

(56) References Cited

U.S. PATENT DOCUMENTS

| | | | | |
|---|---|---|---|---|
| 5,806,506 | A | 9/1998 | Kitamura et al. | |
| 6,668,812 | B2 * | 12/2003 | Javaherian | 123/673 |
| 7,063,080 | B2 * | 6/2006 | Kita et al. | 123/673 |
| 7,195,008 | B2 * | 3/2007 | Annoura et al. | 123/674 |
| 7,721,591 | B2 * | 5/2010 | Maegawa | 73/114.72 |
| 2005/0022797 | A1 | 2/2005 | Ikemoto et al. | |
| 2007/0175462 | A1 * | 8/2007 | Okamoto et al. | 123/673 |
| 2009/0211350 | A1 * | 8/2009 | Iwazaki et al. | 73/114.72 |
| 2010/0082297 | A1 * | 4/2010 | Turin et al. | 702/183 |

* cited by examiner

*Primary Examiner* — Erick Solis
(74) *Attorney, Agent, or Firm* — Nixon & Vanderhye PC

(57) ABSTRACT

In view of a difference in detectability of an air-fuel ratio sensor with respect to each cylinder, a first exhaust system model and a second exhaust system model are defined. The first exhaust system model outputs an air-fuel ratio at the confluent portion based on an air-fuel ratio in a cylinder. The second exhaust system model outputs a detection value of the exhaust gas sensor based on the air-fuel ratio at the confluent portion. A confluent-portion-air-fuel ratio estimating portion designed based on the second exhaust system model estimates the air-fuel ratio at the confluent portion. A combust-air-fuel ratio estimating portion designed based on the first exhaust system model estimates a combust-air-fuel ratio in each cylinder.

30 Claims, 12 Drawing Sheets

CONTROLLER FOR INTERNAL COMBUSTION ENGINE

CROSS-REFERENCE TO RELATED APPLICATION

This application is based on Japanese Patent Application No. 2011-85045 filed on Apr. 7, 2011, the disclosure of which is incorporated herein by reference.

TECHNICAL FIELD

The present disclosure relates to a controller for an internal combustion engine having multi-cylinders. The controller has a function in which air-fuel ratio in each cylinder can be estimated based on detection values of an exhaust gas sensor arranged in a confluent portion of exhaust gas.

BACKGROUND

It has been known that air-fuel ratio of exhaust gas emitted from an internal combustion engine is detected by an exhaust gas sensor (for example, air-fuel ratio sensor), and a fuel injection quantity is feedback-controlled so that the detection value of the exhaust gas sensor agrees with a target air-fuel ratio. In a case of a multi-cylinder engine, it is likely that a variation in intake air quantity may occur between cylinders due to a difference in shape of each intake manifold and/or a variation in intake valve operation. In a case of multi point injection (MPI) system, it is likely that the fuel injection quantity in each cylinder may be different form each other due to an individual difference of a fuel injector provided to each cylinder. Such a difference in intake air quantity and/or fuel injection quantity between cylinders may increase a difference in air-fuel ratio in each cylinder and deteriorates an accuracy of air-fuel ratio control.

In order to solve the above problems, it is proposed that an air-fuel ratio of each cylinder is estimated based on a detection value of the exhaust gas sensor and the air-fuel ratio (fuel injection quantity) of each cylinder is corrected based on the estimated air-fuel ratio so that the variation in air-fuel ratio between cylinders becomes smaller. Japanese Patent No. 3683355 (U.S. Pat. No. 5,806,506) shows an air-fuel estimating system in which an observer which observes an internal condition of an engine is established based on a model representing a behavior of the exhaust gas. Based on detection value of an exhaust gas sensor (air-fuel ratio sensor) which is disposed at a confluent portion of the exhaust gas, the air-fuel ratio of each cylinder is estimated.

In such a system having an exhaust gas sensor disposed at a confluent portion of exhaust gas, due to a difference in flow direction of exhaust gas discharged from each cylinder, a difference in length of an exhaust manifold of each cylinder and an interval of combustion in each cylinder, an output characteristic of the exhaust gas may be varied with respect to each cylinder. That is, it is likely that a difference in detectability of the exhaust gas sensor may occur with respect to air-fuel ratio of each cylinder. The air-fuel ratio of each cylinder can not be estimated with high accuracy.

SUMMARY

It is an object of the present disclosure to provide a controller for an internal combustion engine, which is less affected by a variation in detection value of an exhaust gas sensor relative to an air-fuel ratio in each cylinder and is able to estimate the air-fuel ratio in each cylinder.

According to the present disclosure, a controller for an internal combustion engine includes an air-fuel ratio estimating portion which performs a cylinder-by-cylinder air-fuel ratio estimation based on a detection value of an exhaust gas sensor arranged in a confluent portion of an exhaust gas flowed from multiple cylinders. The air-fuel ratio estimating portion defines: a first exhaust system model which outputs an air-fuel ratio at the confluent portion based on an air-fuel ratio in a cylinder; and a second exhaust system model which outputs the detection value of the exhaust gas sensor based on the air-fuel ratio at the confluent portion. The air-fuel ratio estimating portion includes: a confluent-portion-air-fuel ratio estimating portion which estimates the air-fuel ratio at the confluent portion based on the detection value of the exhaust gas sensor and the second exhaust system model; and a combust-air-fuel ratio estimating portion which estimates a combust-air-fuel ratio of each cylinder based on the air-fuel ratio at the confluent portion and the first exhaust system model.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Embodiments of the present invention will be described, hereinafter.

First Embodiment

Referring to FIGS. 1 to 8, a first embodiment will be described hereinafter.

Figure 1:
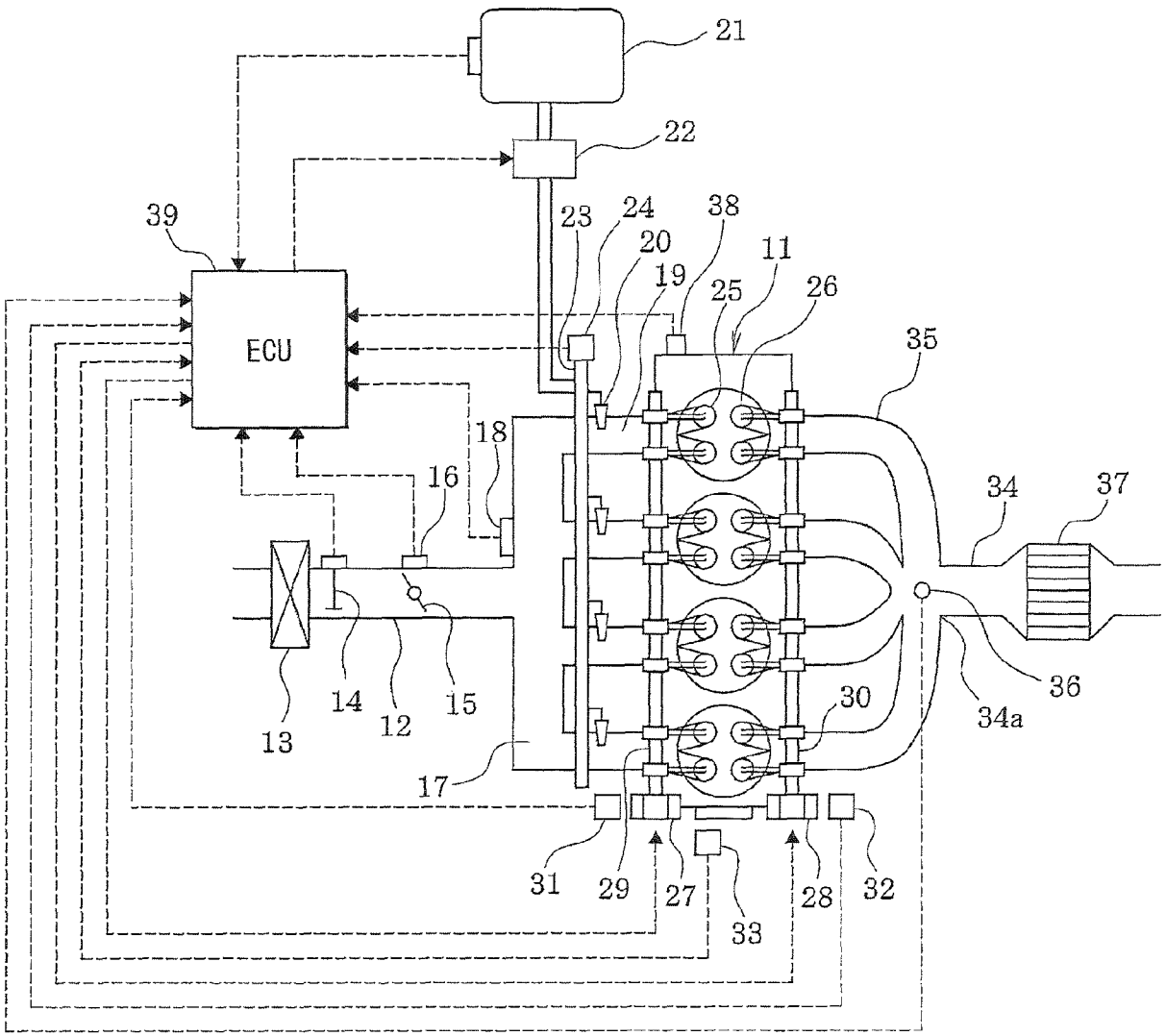
FIG. 1 is a schematic view of an engine control system according to a first embodiment of the present invention.

First, referring to FIG. 1, an engine control system is explained. An air cleaner 13 is arranged upstream of an intake pipe 12 of an internal combustion engine 11. An airflow meter 14 detecting an intake air flow rate is provided downstream of the air cleaner 13. The engine 11 is an inline four-cylinder engine. A throttle valve 15 driven by a DC-motor and a throttle position sensor 16 detecting a throttle position are provided downstream of the air flow meter 14.

A surge tank 17 including an intake air pressure sensor 18 is provided downstream of the throttle valve 15. The intake air pressure sensor 18 detects intake air pressure. An intake manifold 19 which introduces air into each cylinder of the engine 11 is provided downstream of the surge tank 17, and the fuel injector 20 which injects the fuel is provided at a vicinity of an intake port of the intake manifold 19 of each cylinder. While the engine 11 is running, the fuel in the fuel tank 21 is supplied to a delivery pipe 23 by a fuel pump 22. The fuel injector 20 provided to each cylinder injects the fuel into a cylinder. A fuel pressure sensor 24 detecting a fuel pressure is attached to the delivery pipe 23.

The engine 11 is provided with variable valve timing controllers 27, 28 which respectively adjust a valve timing of an intake valve 25 and an exhaust valve 26. Furthermore, the engine 11 is provided with an intake-cam-angle sensor 31 and an exhaust-cam-angle sensor 32. A crank angle sensor 33 is arranged for detecting a rotational angle of a crankshaft.

At a confluent portion 34*a* of an exhaust manifold 35, an air-fuel ratio sensor 36 (exhaust gas sensor) which detects the air-fuel ratio of the exhaust gas is provided. A three-way catalyst 37 which purifies the exhaust gas is provided downstream of the air-fuel ratio sensor 36. A coolant temperature sensor 38 detecting coolant temperature is fixed on the cylinder block of the engine 11.

The outputs of the above sensors are transmitted to an electronic control unit (ECU) 39. The ECU 39 includes a microcomputer which executes an engine control program stored in a Read Only Memory (ROM) to control a fuel injection quantity, an ignition timing, a throttle position (intake air flow rate) and the like.

When a specified control condition is established, the ECU 39 executes an air-fuel ratio feedback control in which a fuel injection quantity to each cylinder is adjusted so that the air-fuel ratio detected by the air-fuel ratio sensor 36 agrees with a target air-fuel ratio.

Figure 2:
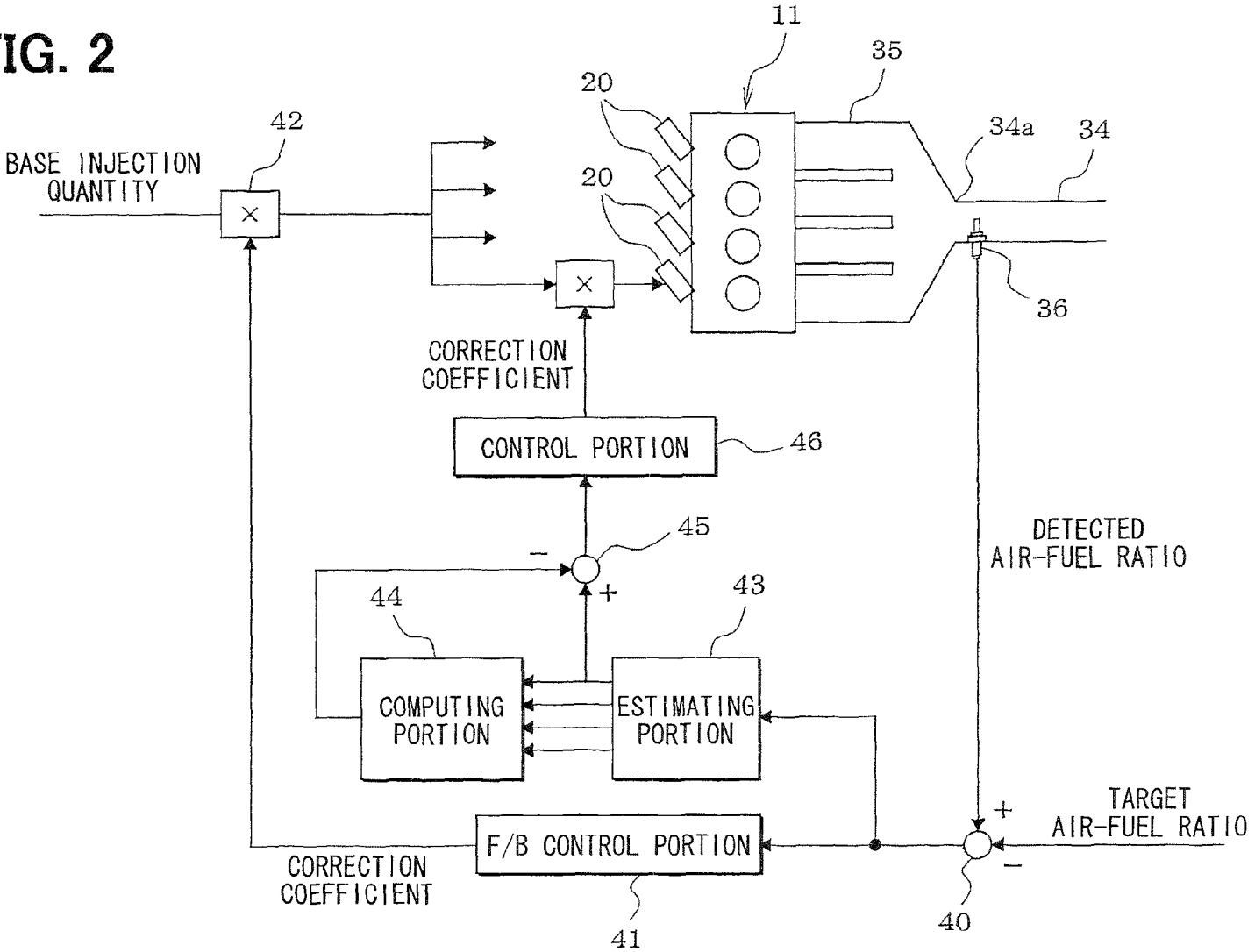
FIG. 2 is a schematic diagram illustrating a fuel injection quantity control system.

Specifically, as shown in FIG. 2, a difference computing portion 40 computes a difference between the detected air-fuel ratio and the target air-fuel ratio. An air-fuel ratio feedback control portion 41 computes a correction coefficient in order to reduce the difference. An injection-quantity computing portion 42 computes a final fuel injection quantity based on a base quantity and the correction coefficient. Each of fuel injector 20 injects the fuel of the final injection quantity.

In the above air-fuel ratio feedback control, the fuel injection quantity to each cylinder is controlled based on the air-fuel ratio detected in the confluent portion 34*a*. Practically, the detected air-fuel ratio varies for each cylinder.

The ECU 39 functions as a cylinder-by-cylinder air-fuel ratio estimating portion which estimates a combust-air-fuel ratio in each cylinder based on the detection value of the air-fuel ratio sensor 36. Further, the ECU 39 functions as a cylinder-by-cylinder air-fuel ratio control portion which executes a cylinder-by-cylinder air-fuel ratio control in which the fuel injection quantity to each cylinder is corrected based on the estimated air-fuel ratio of each cylinder.

Specifically, as shown in FIG. 2, an air-fuel ratio estimating portion 43 estimates air-fuel ratio in each cylinder as follows. In order to consider the difference in detectability of the air-fuel ratio sensor 36 with respect to each cylinder, a first exhaust system model and a second exhaust system model are defined. In the first exhaust system model, the air-fuel ratio of gas flowing into the confluent portion 34*a* is obtained by adding a history of the combust-air-fuel ratio to a history of the air-fuel ratio at the confluent portion 34*a*. The histories are multiplied by a specified weight. In the second exhaust system model, the detection value of the air-fuel ratio sensor 36 is obtained by adding the history of the air-fuel ratio at the confluent portion 34*a* to a history of the detection value of the air-fuel ratio sensor 36 respectively. The histories are multiplied by a specified weight. Based on the first and the second exhaust system model, the air-fuel ratio in each cylinder is estimated.

Figure 3:
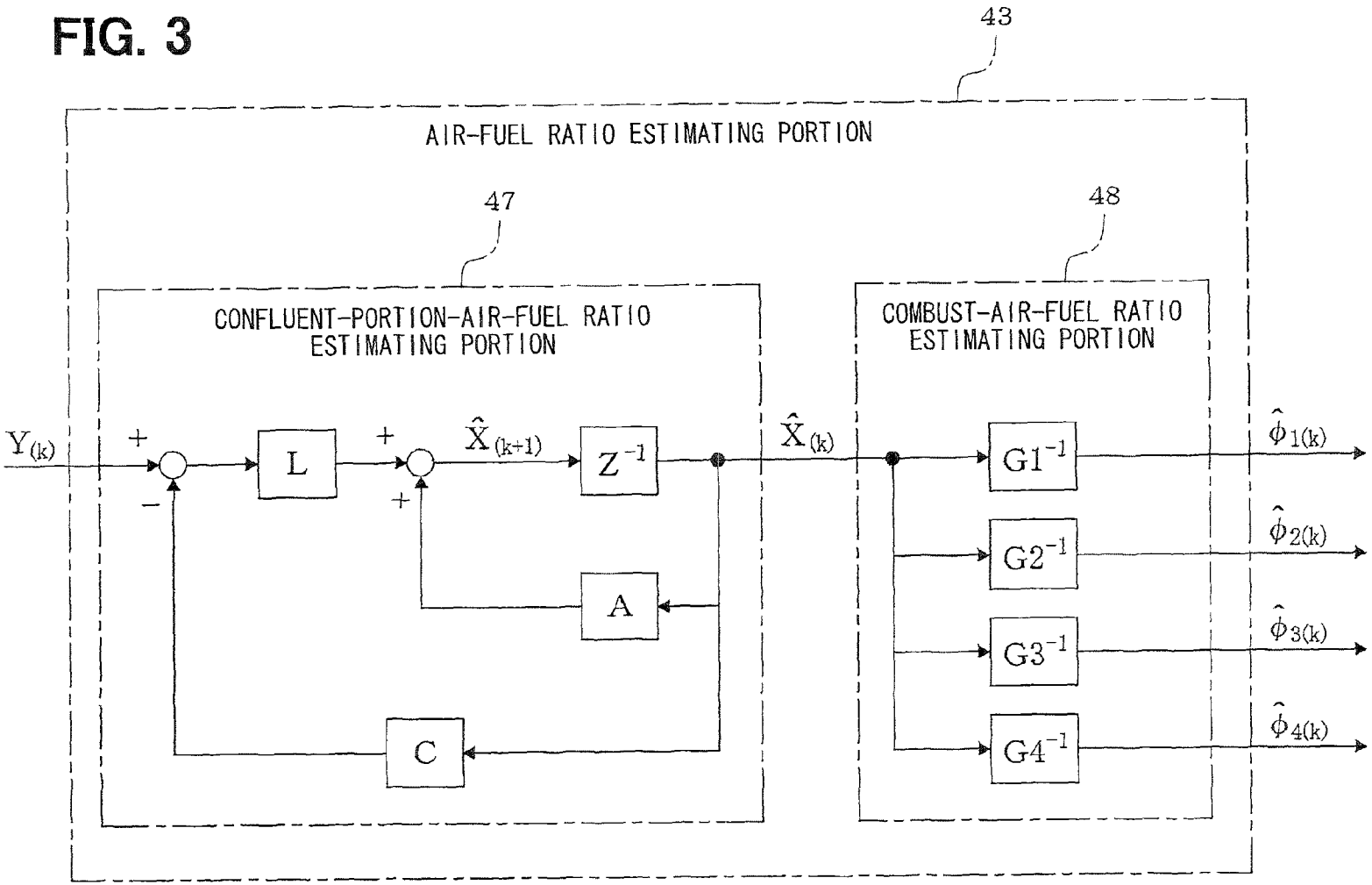
FIG. 3 is a block diagram schematically showing an air-fuel ratio estimating portion.

Referring to FIG. 3, the air-fuel ratio estimating portion 43 will be described in detail. A detection value "y" of the air-fuel ratio sensor 36 is inputted into a confluent-portion-air-fuel ratio estimating portion 47 which is designed based on the second exhaust system model, whereby a confluent-portion-air-fuel ratio "X" is estimated (outputted). This estimated air-fuel ratio "X" is inputted into a combust-air-fuel ratio estimating portion 48 which is designed based on the first exhaust system model, whereby the combust-air-fuel ratio ϕi is estimated (outputted).

In the confluent-portion-air-fuel ratio estimating portion 47, a Kalman-filter type observer based on the second exhaust system model is used. More specifically, a model of gas-exchange at the confluent portion 34*a* is approximated by the following formula (1).

$$ys(k)=b1\times u(k-1)+b2\times u(k-2)-a1\times ys(k-1)-a2\times ys(k-2) \quad (1)$$

wherein "ys" represents a detection value of the air-fuel ratio sensor 36, "u" represents a confluent-portion-air-fuel ratio, and "a1", "a2", "b1", "b2" represent constants.

In the exhaust system, there are the first order lag of exhaust gas flowing into the confluent portion 34*a* and the first order lag of a response of the air-fuel ratio sensor 36. In view of these first order lags, the past two histories are referred in the above formula (1). It should be noted that the order of the model is not limited to "two". For example, the model can be approximated as a forth order model as a following formula (2).

$$ys(k)=b1\times u(k-1)+b2\times u(k-2)+b3\times u(k-3)+b4\times u(k-4)-a1\times ys(k-1)-a2\times ys(k-2)-a3\times ys(k-3)-a4\times ys(k-4). \quad (2)$$

wherein "a1" to "a4" and "b1" to "b4" represent constants.

The above formula (1) is converted into a state space model, whereby following formulas (3a) and (3b) are derived.

$$X(k+1)=A\cdot X(K)+B\cdot u(k)+W(K) \quad (3a)$$

$$Y(k)=C\cdot X(K)+D\cdot u(k) \quad (3b)$$

wherein, "A", "B", "C" and "D" represent parameters of the model, "Y" represents a detection value of the air-fuel ratio sensor 36, "X" represents a confluent-portion-air-fuel ratio as a state variable, and "W" represents noise.

Based on the above formulas (3a), (3b), the Kalman filter is designed as expressed by a following formula (4).

$$\hat{X}(k+1|k)=A\cdot\hat{X}(k|k-1)\{Y(k)-C\cdot\hat{X}(k|k-1) \quad (4)$$

wherein "X^" represents an estimation value of the confluent-portion-air-fuel ratio and "L" represents Kalman gain. X^(k+1|k) represents to obtain an estimation value at a time (k+1) based on the estimation value at a time (k).

As described above, the confluent-portion air-fuel ratio estimating portion 47 is configured by Kalman-filter type observer, whereby the confluent-portion-air-fuel ratio can be successively estimated along with an advance of a combustion cycle. In a configuration shown in FIG. 2, the air-fuel ratio difference is inputted into the air-fuel ratio estimating portion 43. In the above formula (4), the output "Y" is replaced by the air-fuel ratio difference.

In a combust-air-fuel ratio estimating portion 48, an inverse model of the first exhaust system model is used. More specifically, the confluent-portion-air-fuel ratio is approximated by a following formula (5).

$$yc(k)=bi\times ui(k-1)-ai\times yc(k-1) \quad (5)$$

wherein "yc" represents a confluent-portion-air-fuel ratio, "ui" represents a combust-air-fuel ratio in each cylinder, and "ai", "bi" represent constants.

The above formula (5) is converted into a transfer-function, whereby the following formula (6) is obtained.

$$Gi(z)=bi/(z-ai) \quad (6)$$

wherein "Gi" represents a model corresponding to i-th cylinder, and "z" represents an operator indicating a time shift of sampling period in a general z-transformation where a difference equation is transformed into a transfer-function.

The confluent-portion-air-fuel ratio estimated in the estimating portion 47 is inputted into the inverse model expressed by the above formula (6), whereby an estimated air-fuel ratio $\phi i\hat{}$ in each cylinder is computed. It should be noted that the first exhaust system model may be a static model, such as Gi=mi (Scala). In this case, the system model is expressed by $Gi\hat{}(-1)=1/ml$, whereby computation load is reduced and an amplitude difference in detectability of the air-fuel ratio sensor 36 can be compensated.

Alternatively, the first exhaust system model can be established according to an engine driving condition, such as engine speed and engine load. The confluent-portion-air-fuel ratio estimating portion 47 may be changed according to the engine driving condition. Thus, even though the engine driving condition is changed, the combust-air-fuel ratio can be estimated based on an appropriate model, whereby an estimation accuracy of the air-fuel ratio can be improved.

Furthermore, the first exhaust system model can be established according to a response characteristic of the air-fuel ratio sensor 36, and confluent-portion-air-fuel ratio estimating portion 47 may be changed according to the response characteristic of the air-fuel ratio sensor 36. Thus, even though the response characteristic of the air-fuel ratio sensor 36 is changed, the combust-air-fuel ratio can be estimated based on an appropriate model, whereby an estimation accuracy of the air-fuel ratio can be improved.

Furthermore, an estimation-accuracy determination portion may be provided in order to determine an estimation accuracy of the combust-air-fuel ratio estimating portion 48. Based on a determination result of the estimation-accuracy determination portion, an internal parameter of at least one of the confluent-portion-air-fuel ratio estimating portion 47 and the combust-air-fuel ratio estimating portion 48 is changed. Thereby, even if the estimation accuracy of the combust-air-fuel ratio is deteriorated, the internal parameter is changed to a predetermined value so that the estimation accuracy of the combust-air-fuel ratio is hardly deteriorated.

After the air-fuel ratio estimating portion 43 estimates the air-fuel ratio in each cylinder, a reference air-fuel ratio computing portion 44 computes a reference air-fuel ratio based on the air-fuel ratio of each cylinder, as shown in FIG. 2. In the present embodiment, an average of air-fuel ratios of all cylinders (first to fourth cylinders) is computed as the reference air-fuel ratio. When the air-fuel ratio in a cylinder is newly computed, the reference air-fuel ratio is also updated.

Then, a difference computing portion 45 computes a difference between the air-fuel ratio of each cylinder and the reference air-fuel ratio, as an air-fuel ratio variation. An air-fuel ratio control portion 46 computes correction coefficients of each cylinder according to the air-fuel ratio variations. The final fuel injection quantity is corrected by the correction coefficient with respect to each cylinder, so that the air-fuel ratio in each cylinder is corrected.

Figure 4:
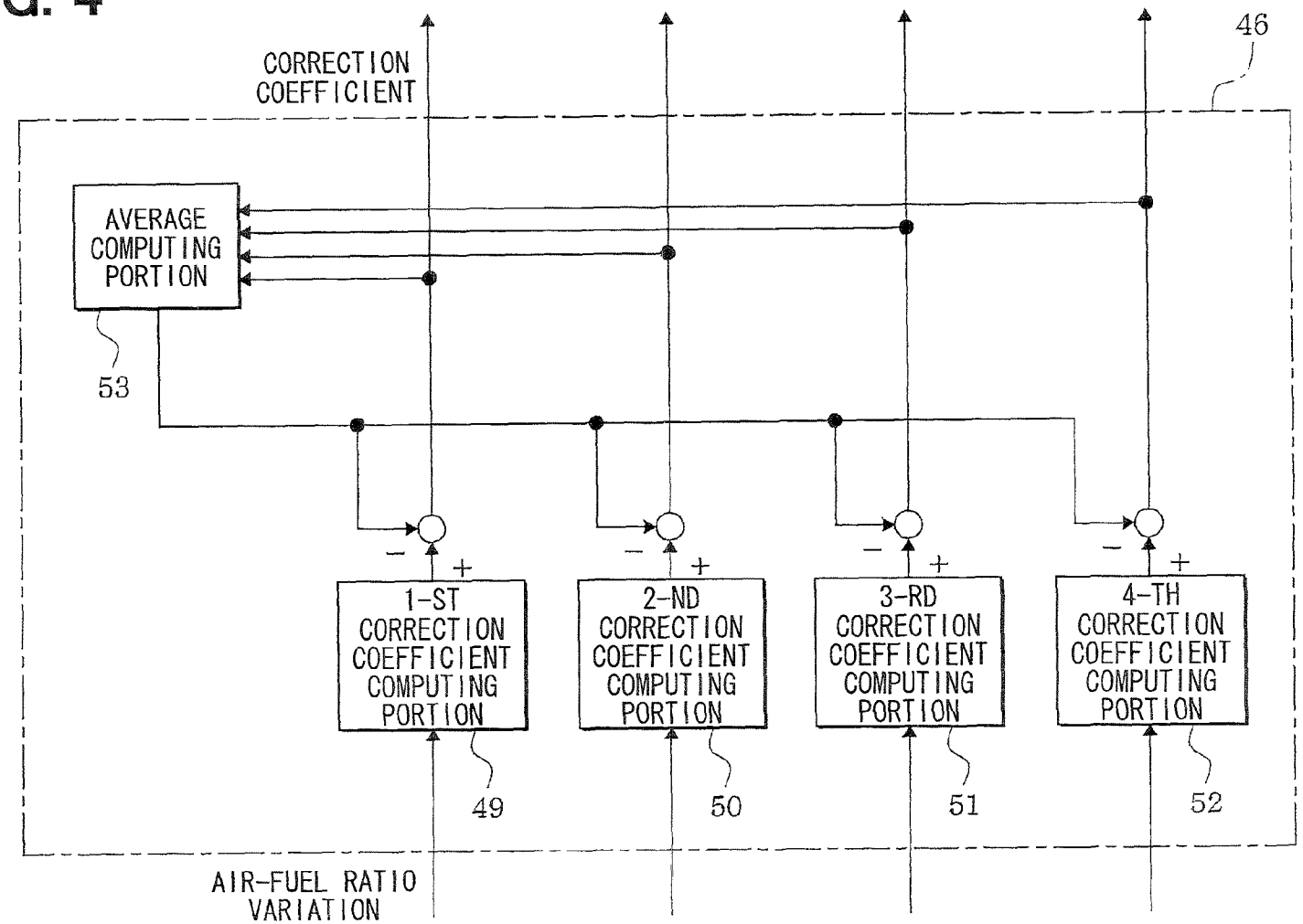
FIG. 4 is a block diagram schematically showing an air-fuel ratio control portion.

Referring to FIG. 4, the air-fuel ratio control portion 46 will be described in detail. The air-fuel ratio variations which are computed with respect to each cylinder are inputted into a first to fourth correction coefficient computing portions 49 to 52. Each of correction coefficient computing portions 49 to 52 computes a correction coefficient with respect to each cylinder so that the air-fuel ratio of each cylinder agrees with the reference air-fuel ratio. The computed correction coefficients are transmitted to an average computing portion 53 in which an average of the correction coefficients of the first to the fourth cylinder is computed. Then, this average value is subtracted from the correction coefficients of each cylinder. The final fuel injection quantity of each cylinder is corrected based on this correction coefficient.

The corrected correction coefficients may have an upper and a lower guard value. The upper guard value and the lower guard value may be the same value. Alternatively, these values may be varied according to the engine driving condition and a response characteristic of the air-fuel ratio sensor 36. Each of feedback gain of the correction coefficient computing portions 49 to 52 may be varied according to the engine driving condition and a response characteristic of the air-fuel ratio sensor 36.

Figure 5:
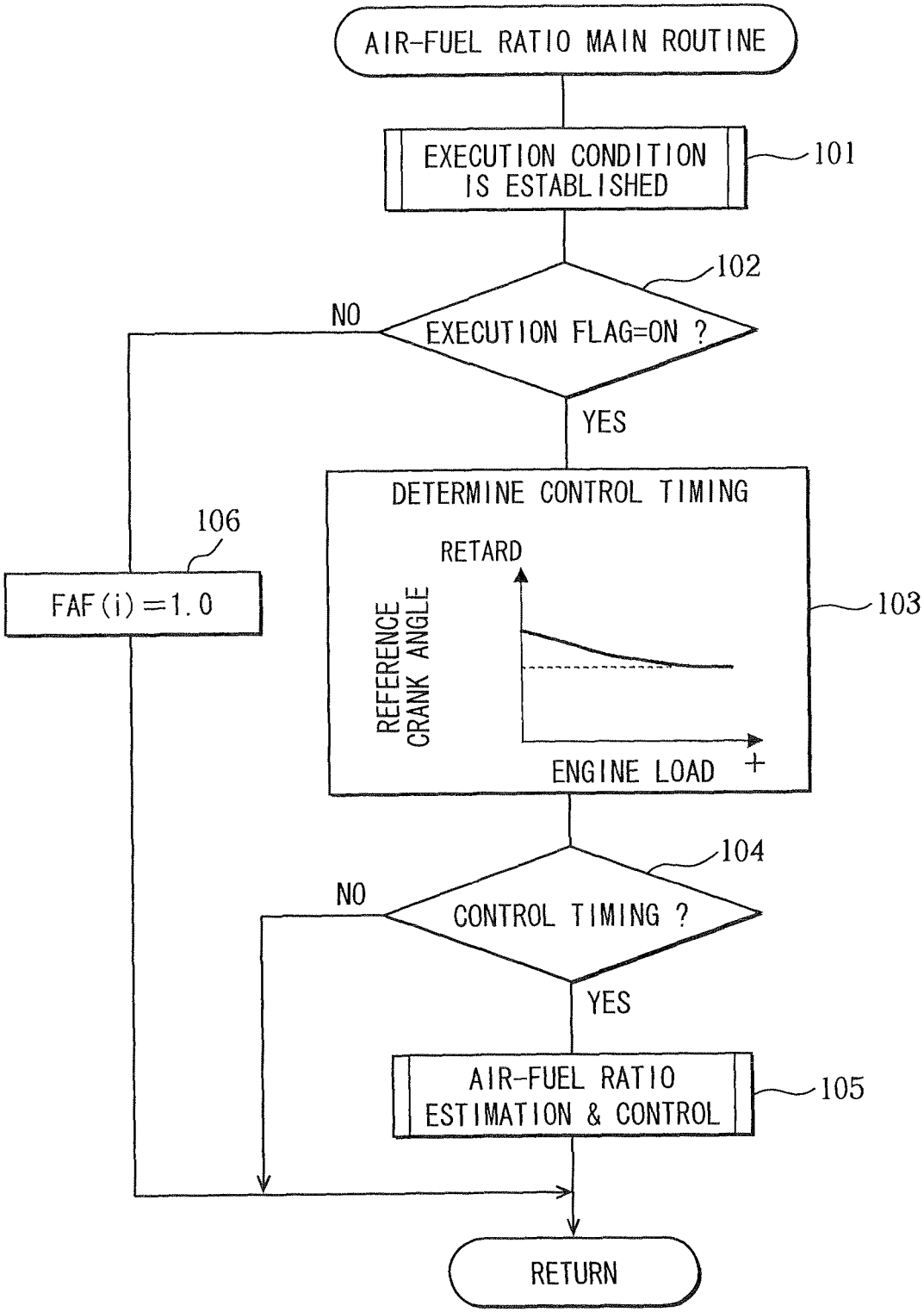
FIG. 5 is a flow chart showing a processing of a main routine of an air-fuel ratio control.
Figure 6:
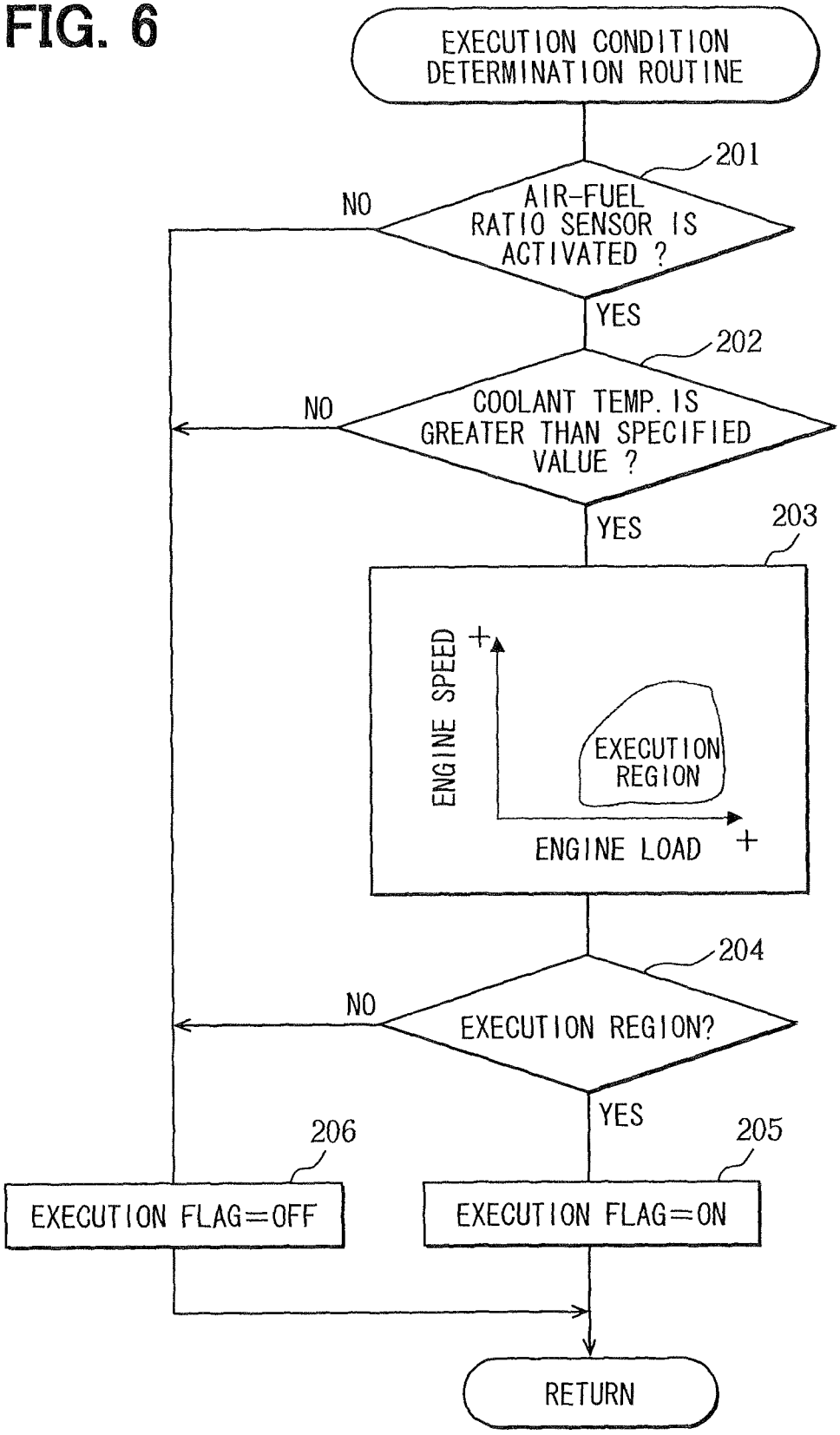
FIG. 6 is a flow chart showing a processing of an execution condition determination routine.
Figure 7:
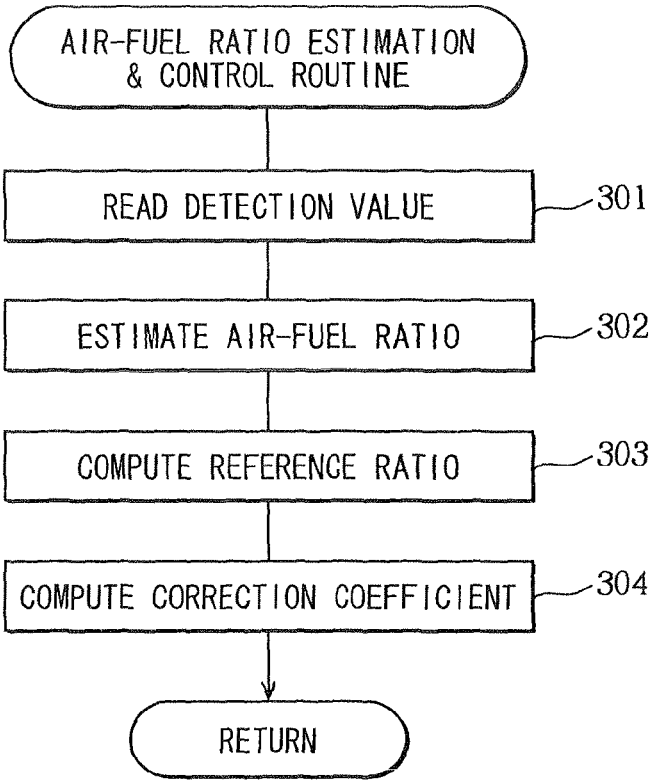
FIG. 7 is a flow chart showing a processing of a cylinder-by-cylinder air-fuel ratio estimation and air-fuel control routine.

The above described cylinder-by-cylinder air-fuel ratio control is executed by the ECU 39 according to each routine shown in FIGS. 5 to 7. The processing of each routine will be described hereinafter.

[Main Routine of Air-Fuel Ratio Control]

A main routine shown in FIG. 5 is executed in synchronization with an output pulse of the crank angle sensor 33. In step 101, it is determined whether an execution condition is established. When the execution condition is established, an execution flag is turned "ON". When the execution condition is not established, the execution flag is turned "OFF".

Then, the procedure proceeds to step 102 in which the computer determines whether the execution flag is "ON". When YES in step 102, the procedure proceeds to step 103 in which the computer determines control timings of the air-fuel ratio estimation and the air-fuel ratio control. At this moment, in view of a reference crank angle map, the computer determines a reference crank angle which corresponds to a current engine load. In the reference crank angle map, the reference crank angle is retarded as the engine load becomes lower. In a low-engine-load region, the velocity of exhaust-gas-flow becomes lower. In view of this, the reference crank angle is determined and a control timing is determined based on the reference crank angle.

Figure 8:
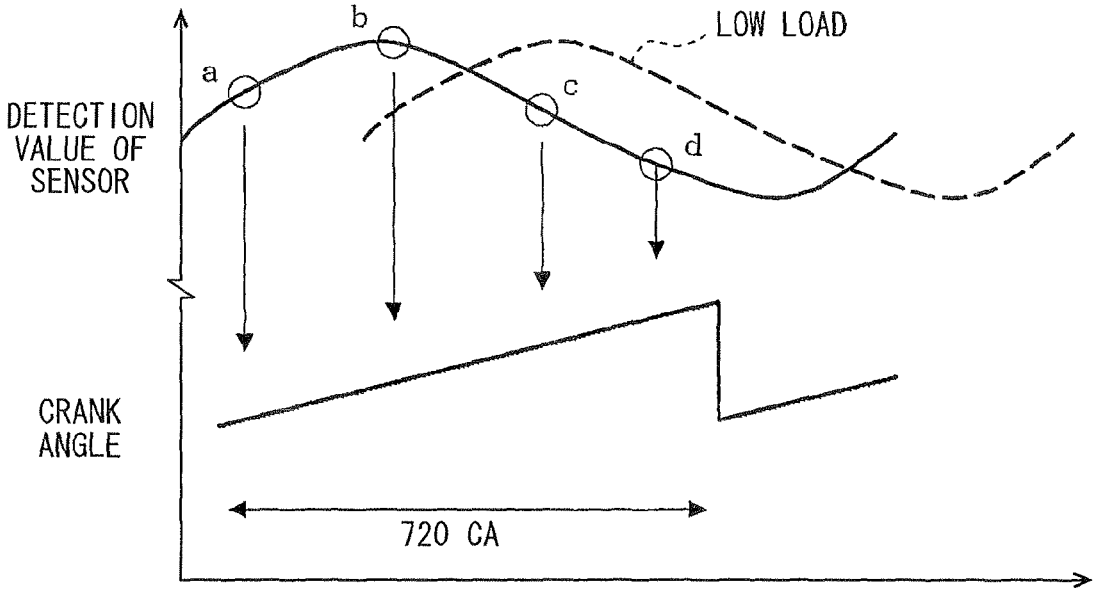
FIG. 8 is a graph showing a relationship between a detection value of an air-fuel ratio sensor and a crank angle.

It should be noted that the reference crank angle is used for obtaining a detection value of the air-fuel ratio sensor 36. The reference crank angle varies according to an engine load. As shown in FIG. 8, the detection value of the air-fuel ratio sensor 36 varies due to an individual difference between cylinders. This variation pattern of the detection value of the air-fuel ratio sensor 36 is in synchronization with the crank angle. Also, this variation pattern is retarded as the engine load is lower. For example, when the detection value should be detected at time points "a", "b" and "c" in FIG. 8, it is likely that the detection value of the air-fuel ratio sensor 36 may deviate from actual value due to an engine load variation.

However, since the reference crank angle is variably established, the detection value of the air-fuel ratio sensor 36 can be obtained at proper timings.

Then, the procedure proceeds to step 104 in which the computer determines whether the crank angle detected by the crank angle sensor 33 is the reference crank angle, whereby the computer determines whether it is control timings of the air-fuel ratio estimation and the air-fuel ratio control. When the answer is YES in step 104, the procedure proceeds to step 105 in which control routine of the air-fuel ratio estimation and the air-fuel ratio control shown in FIG. 7 is executed.

Meanwhile, when the answer is NO in step 102, the procedure proceeds to step 106 in which a correction coefficient FAF(i) of each cylinder is set to "1.0".

[Execution Condition Determination Routine]

An execution condition determination routine shown in FIG. 6 is a subroutine executed in step 101 of the main routine shown in FIG. 5. In step 201, the computer determines whether the air-fuel ratio sensor 36 is activated. When the answer is YES in step 201, the procedure proceeds to step 202 in which the computer determines whether engine coolant temperature is greater than a specified value (for example, 70° C.).

When the answer is NO in step 201 or 202, the procedure proceeds to step 206 in which the execution flag is turned "OFF".

When the answer is YES in step 201 and 202, the procedure proceeds to step 203 in which the computer determines whether the current engine driving condition corresponds to the execution condition in view of a driving region map. When the engine speed is high or the engine load is low, the air-fuel ratio control is prohibited. The execution condition region may be corrected according to a variation in response characteristic of the air-fuel ratio sensor 36. Also, if an absolute value of a variation in detection value of the air-fuel ratio sensor 36 is greater than a specified value, the air-fuel ratio control may be prohibited.

Then, the procedure proceeds to step 204 in which the computer determines whether the current engine driving condition has been determined to be in the execution condition based on the result in step 203. When the answer is YES in step 204, the procedure proceeds to step 205 in which the execution flag is turned "ON".

When the answer is NO in step 204, the procedure proceeds to step 206 in which the execution flag is turned "OFF".

As described above, when the execution condition is established for the air-fuel ratio estimation and the air-fuel ratio control, the estimation and the control can be executed.

It should be noted that the execution condition may includes a fact that a specified time has not elapsed after the fuel cut is terminated. Thus, it can be avoided that the estimation accuracy of the air-fuel ratio is deteriorated.

[Cylinder-by-Cylinder Air-Fuel Ratio Estimation and Air-Fuel Control Routine]

A cylinder-by-cylinder air-fuel ratio estimation and air-fuel control routine shown in FIG. 7 is a subroutine executed in step 105 of the main routine shown in FIG. 5. This routine is started when the crank angle becomes the reference crank angle. In step 301, the computer reads the detection value of the air-fuel ratio sensor 36. In step 302, the computer estimates the confluent-portion-air-fuel ratio based on the detection value of the air-fuel ratio sensor 36. Further, based on this estimated confluent-portion-air-fuel ratio, the combust-air-fuel ratio of each cylinder is estimated. The detection value of the air-fuel ratio sensor 36 may be band-pass filtered.

According to the present embodiment, the confluent-portion-air-fuel ratio is estimated based on the detection value of the air-fuel ratio sensor 36 when the crank angle becomes the reference crank angle. The reference crank angle is determined according to the engine load. Thus, the confluent-portion-air-fuel ratio can be estimated based on the detection value of the air-fuel ratio sensor 36 at a proper timing which corresponds to the engine load. The estimation accuracy of the confluent-portion-air-fuel ratio can be improved.

Further, the combust-air-fuel ratio can be estimated based on the confluent-portion-air-fuel ratio at a proper timing which corresponds to the engine load. The estimation accuracy of the combust-air-fuel ratio of each cylinder can be improved.

Besides, the reference crank angle may be corrected according to a valve close timing of the exhaust valve 26. With this configuration, even if a timing when the exhaust gas flows into the exhaust manifold 35 is varied according to the valve close timing of the exhaust valve 26, the reference crank angle is also corrected, whereby the estimation accuracy of the confluent-portion-air-fuel ratio and the combust-air-fuel ratio of each cylinder can be improve.

Then, the procedure proceeds to step 303 in which an average value of the estimated air-fuel ratio of all cylinders is computed and is defined as the reference air-fuel ratio. Then, the procedure proceeds to step 304 in which a difference between the reference air-fuel ratio and the combust-air-fuel ratio of each cylinder is computed and is defined as a cylinder-by-cylinder air-fuel ratio variation. Based on this air-fuel ratio variation, the correction coefficients of each cylinder are computed. At this moment, as described above based on FIG. 4, an average of the correction coefficients is computed and is subtracted from the correction coefficients of each cylinder, whereby the final cylinder-by-cylinder correction coefficients are obtained. The final fuel injection quantity of each cylinder is corrected by the final correction coefficients to correct the air-fuel ratio of each cylinder.

According to the present embodiment, since the reference crank angle is determined according to the engine load, the correction coefficients are computed at proper timings according to the engine load. Thus, the accuracy of the cylinder-by-cylinder air-fuel ratio control can be improved.

Besides, after a dead zone is provided to the difference between the combust-air-fuel ratio and the reference air-fuel ratio, the air-fuel ratio of each cylinder can be computed. In a case that an absolute value of the difference is smaller than a specified minute value, the difference is defined as "0" so that a stability of the control is improved. The width of the dead zone may be the constant values with respect to each cylinder. Alternatively, the width of the dead zone may be varied according to the engine driving condition and a response characteristic of the air-fuel ratio sensor 36.

As described above, according to the present embodiment, considering the difference in detectability of the air-fuel ratio sensor 36 with respect to each cylinder, the first exhaust system model and the second exhaust system model are defined. In the first exhaust system model, the air-fuel ratio of gas flowing into the confluent portion 34*a* is obtained by adding a history of the combust-air-fuel ratio to a history of the air-fuel ratio at the confluent portion 34*a*. The histories are multiplied by a specified weight. In the second exhaust system model, the detection value of the air-fuel ratio sensor 36 is obtained by adding the history of the air-fuel ratio at the confluent portion 34*a* to a history of the detection value of the air-fuel ratio sensor 36. The histories are multiplied by a specified weight. A detection value of the air-fuel ratio sensor 36 is inputted into a confluent-portion-air-fuel ratio estimating portion 47 which is designed based on the second exhaust system model, whereby a confluent-portion-air-fuel ratio is estimated (outputted). This estimated air-fuel ratio is inputted into a combust-air-fuel ratio estimating portion 48 which is designed based on the first exhaust system model, whereby the combust-air-fuel ratio in each cylinder is estimated (outputted).

Thereby, the difference in the detectability of the air-fuel ratio sensor 36 with respect to each cylinder can be properly compensated. The estimation accuracy of the estimating portion 47 can be improved. The air-fuel ratio can be accurately estimated cylinder-by-cylinder. As a result, the controllability of air-fuel ratio control and the detectability of an air-fuel-ratio imbalance between cylinders can be improved.

Moreover, according to the present embodiment, the first exhaust system model outputs the confluent-portion-air-fuel ratio in view of a difference in detectability of the air-fuel ratio sensor 36. Thus, the second exhaust system model can be accurately defined.

Furthermore, according to the present embodiment, the second exhaust system model outputs the detection value of the air-fuel ratio sensor 36 by adding the history of the air-fuel ratio at the confluent portion 34*a* to a history of the detection value of the air-fuel ratio sensor 36. The histories are multiplied by a specified weight. Thus, the second exhaust system model is defined in view of a gas mixture at the confluent portion 34*a*, whereby the combust-air-fuel ratio of each cylinder can be computed in view of a gas-exchange behavior at the confluent portion 34*a*. Moreover, since the model (autoregressive model) which estimates the detection value of the air-fuel ratio sensor 36 from the past values is used, it is unnecessary to increase the history in order to improve the accuracy. As a result, the models can be easily defined and the air-fuel ratio can be accurately estimated.

Moreover, since the confluent-portion-air-fuel ratio is estimated by an observer based on the second exhaust system model, it is possible to reduce noises. Also, since the combust-air-fuel ratio is estimated by the inverse model of the first exhaust system model, the combust-air-fuel ratio of each cylinder can be easily estimated from the confluent-portion-air-fuel ratio.

According to the present embodiment, the air-fuel ratio variations between cylinders are computed based on the estimated air-fuel ratio of each cylinder and the fuel injection quantity of each cylinder is corrected based on the correction coefficients which are computed based on the air-fuel ratio variations. Thus, the air-fuel ratio variation between cylinders can be made smaller, whereby the air-fuel ratio control can be executed with high accuracy.

A difference between the reference air-fuel ration and the combust-air-fuel ratio of each cylinder is defined as the air-fuel ratio variation. Thus, the air-fuel ratio of each cylinder can be corrected based on the reference air-fuel ratio.

According to the present embodiment, an average of the correction coefficients of each cylinder is computed and this average is subtracted from the correction coefficients of each cylinder. Thus, the cylinder-by-cylinder air-fuel ratio control does not interfere with a usual feedback control of air-fuel ratio. That is, in a usual air-fuel ratio feedback control, the detected air-fuel ratio at a confluent portion is adjusted in such a manner as to agree with a target value. Meanwhile, in the present cylinder-by-cylinder air-fuel ratio control, the air-fuel ratio variation between cylinders is absorbed.

Furthermore, since the cylinder-by-cylinder air-fuel ratio control is executed when a specified execution condition is established, the cylinder-by-cylinder air-fuel ratio control can be executed based on the air-fuel ratio of each cylinder which is accurately estimated, whereby the accuracy of the air-fuel ratio control can be improved.

In a usual air-fuel ratio feedback control, if a modeling error and disturbance become large due to an air-fuel ratio variation between cylinders, it is likely that a control stability may be deteriorated.

A feedback gain of the air-fuel ratio feedback control may be varies according to the air-fuel ratio variation between cylinders. When the air-fuel ratio variation is greater than a specified value, the feedback gain is reduced. Thus, the stability of the air-fuel ratio control can be ensured.

Second Embodiment

Referring to FIGS. 9 to 13, a second embodiment will be described hereinafter. In the second embodiment, the same parts and components as those in the first embodiment are indicated with the same reference numerals and the same descriptions will not be reiterated.

Depending on an engine driving condition, it is likely that the air-fuel ratio can not be estimated.

Figure 9:
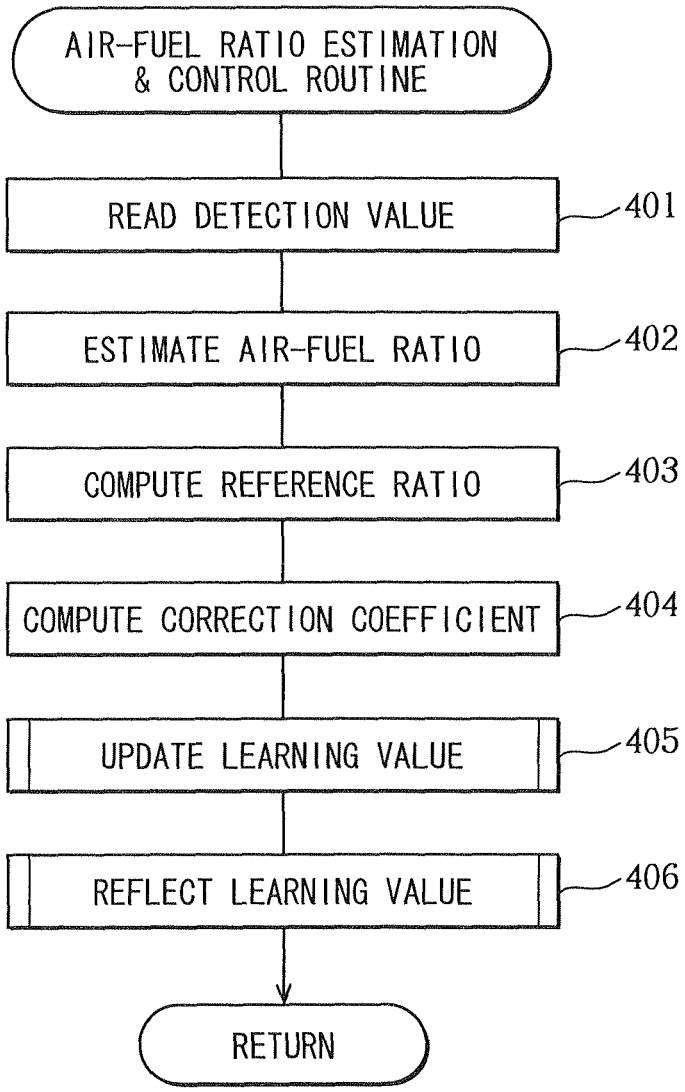
FIG. 9 is a flow chart showing a processing of a cylinder-by-cylinder air-fuel ratio estimation and air-fuel control routine according to a second embodiment.
Figure 10:
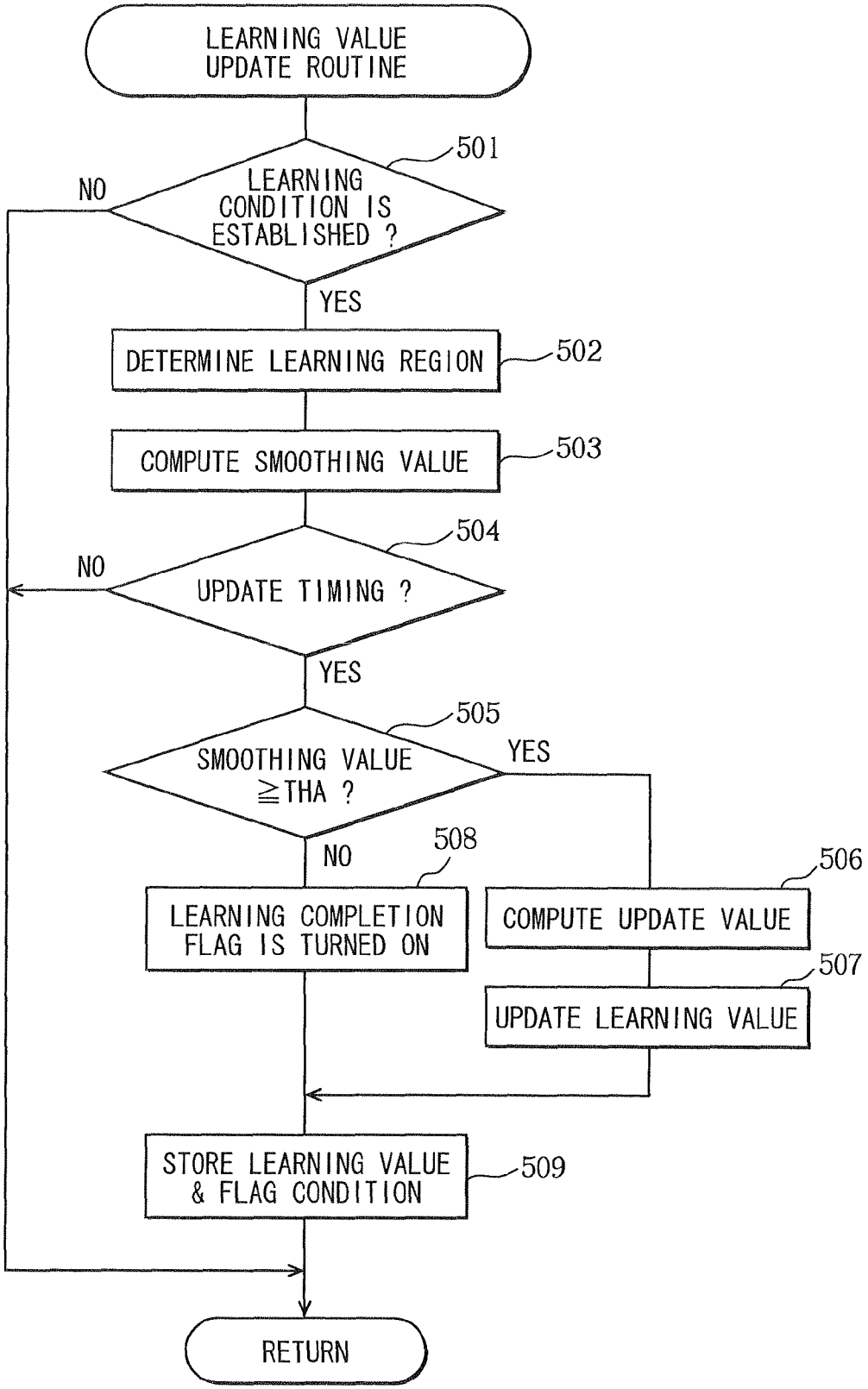
FIG. 10 is a flow chart showing a processing of a learning value update routine.
Figure 11:
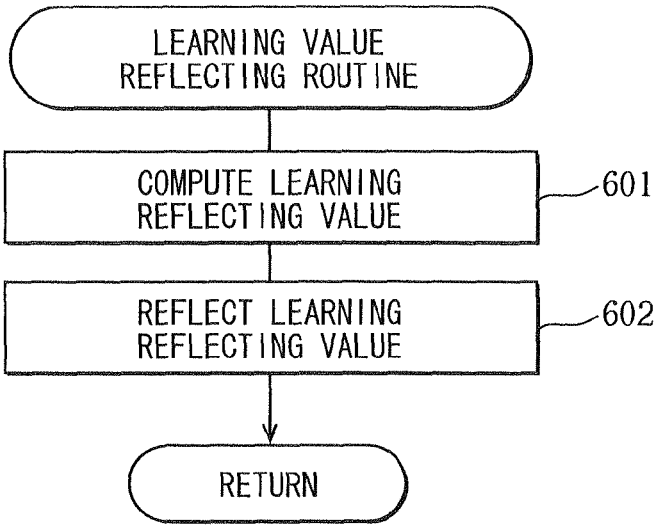
FIG. 11 is a flow chart showing a processing of a learning value reflecting routine.

According to the second embodiment, the ECU 39 executes each of routines shown in FIGS. 9 to 11. While a cylinder-by-cylinder air-fuel ratio control is executed, a learning value is computed with respect to each cylinder based on the correction coefficients of each cylinder. This learning value of each cylinder is stored in a backup memory, such as a standby RAM and an EEPROM. The cylinder-by-cylinder air-fuel ratio control is executed in view of the learning value stored in the memory. The ECU 39 functions as a learning portion and a learning-value-reflecting portion.

[Cylinder-by-Cylinder Air-Fuel Ratio Estimation and Air-Fuel Control Routine]

FIG. 9 shows a cylinder-by-cylinder air-fuel ratio estimation and air-fuel control routine, which corresponds to the routine shown in FIG. 7 of the first embodiment. The procedures in steps 401 to 404 are the same as those in steps 301 to 304.

In step 401, the computer reads the detection value of the air-fuel ratio sensor 36. In step 402, the computer estimates the confluent-portion-air-fuel ratio based on the detection value of the air-fuel ratio sensor 36. Further, based on this estimated confluent-portion-air-fuel ratio, the combust-air-fuel ratio of each cylinder is estimated.

In step 403, an average of the estimated air-fuel ratios of all cylinders is computed as a reference air-fuel ratio. Then, the procedure proceeds to step 404 in which a difference between the reference air-fuel ratio and the combust-air-fuel ratio of each cylinder is computed and is defined as a cylinder-by-cylinder air-fuel ratio variation. Based on this air-fuel ratio variation, the correction coefficients of each cylinder are computed.

In step 405, the computer executes a learning value update routine, which is shown in FIG. 10, to compute a learning value of each cylinder based on the correction coefficients of each cylinder. This learning value is stored in the memory.

In step 406, the computer executes a learning-value-reflecting routine shown in FIG. 11, whereby the cylinder-by-cylinder air-fuel ratio control is executed in view of the learning value stored in the memory.

[Learning Value Update Routine]

A learning value update routine shown in FIG. 10 is a subroutine executed in step 405 of FIG. 9. In step 501, the computer determines whether following three conditions are satisfied.

(I) The cylinder-by-cylinder air-fuel ratio control is executed.

(II) An engine coolant temperature is greater than a specified value (for example, minus 10° C.).

(III) A variation in air-fuel ratio is lower than a specified value and the air-fuel ratio is stable.

The condition (III) will be described more in detail. When a difference ΔA/F1 (absolute value) between a current value and a previous value of the detected air-fuel ratio (detection value of the air-fuel ratio sensor 36) is less than a specified value TH1 and a difference ΔA/F2 (absolute value) between a current value and a value before 720° CA of the detected air-fuel ratio is less than a specified value TH2, the above condition (III) is satisfied.

If all of the above three conditions (I)-(III) are satisfied, the learning execution condition is established. If at least one of the above is not satisfied, the learning execution condition is not established.

When the computer determines that the learning execution condition is established in step 501, it is permitted to update the learning value of each cylinder. When the learning execution condition is not established, it is prohibited to update the learning value.

By defining the learning execution condition, it can be avoided to erroneously learn the learning value of each cylinder.

When the answer is YES in step 501, the procedure proceeds to step 502 in which the computer determines a current learning regions which is defined by an engine speed and an engine load as parameters. Then, the procedure proceeds to step 503 in which a smoothing value of the correction coefficient is computed with respect to each cylinder. Specifically, the smoothing value is computed according to the following formula.

$$\text{Smoothing Value}=\text{Previous Smoothing Value}+K\times(\text{Current Correction Coefficient}-\text{Previous Smoothing Value})$$

wherein "K" represents a smoothing coefficient (for example, "K"=0.25)

Then, the procedure proceeds to step 504 in which the computer determines whether a current procedure is at the update timing of the learning value. This update timing of the learning value is established in such a manner that an update cycle of the learning value is longer than a computing cycle of the correction coefficient. Thereby, an erroneous learning due to rapid update of the learning value can be avoided.

When the answer is YES in step 504, the procedure proceeds to step 505 in which the computer determines whether an absolute value of the smoothing value of the correction coefficient is greater than or equal to a specified value THA. The specified value THA is defined in such a manner that a difference between an average of the air-fuel ratios and each air-fuel ratio corresponds to a value in which an excess air factor (λ) is not less than 0.01.

Figure 12:
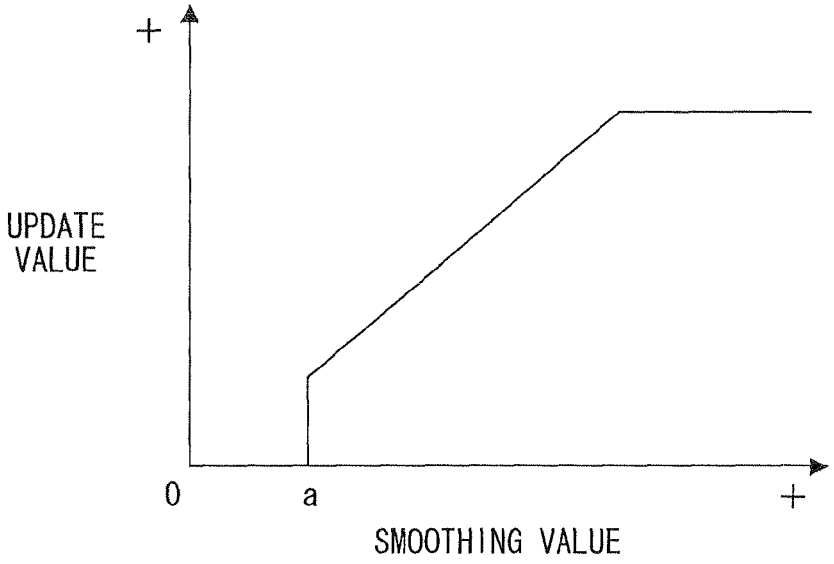
FIG. 12 is a graph showing a relationship between a smoothing value of a correction coefficient and a learning value update quantity.

When the answer is YES in step 505, the procedure proceeds to step 506 in which an update value of the learning value is computed. The update value of the learning value is computed based on a relationship shown in FIG. 12. As the smoothing value is larger, the update value is set larger. In FIG. 12, when the smoothing value is not greater than "a", the update value is set to "0". This value "a" corresponds to the specified value THA in step 505. Then, the procedure proceeds to step 507 in which the learning value of each cylinder is updated. That is, the update value is added to the previous learning value to obtain a current learning value.

When the answer is NO in step 505, the procedure proceeds to step 508 in which a learning completion flag is turned ON.

Figure 13:
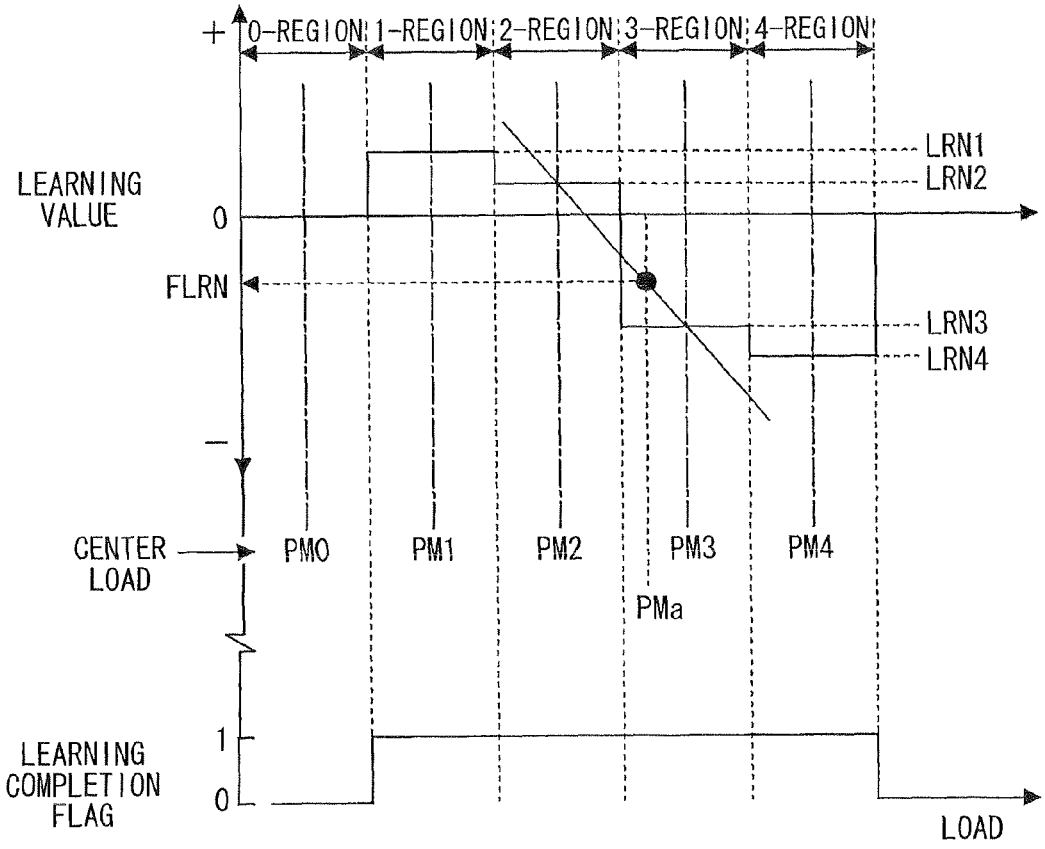
FIG. 13 is a chart for explaining a storage configuration of a learning value and a learning completion flag.

Then, the procedure proceeds to step 509 in which the learning value of each cylinder and the condition of the learning completion flag are stored in the memory. At this moment, the learning value and the condition of the learning completion flag are stored in each driving region. As shown in FIG. 13, the engine driving region is divided into O-region, 1-region, 2-region, 3-region and 4-region according to the engine load level (for example, intake air pressure PM). In each region, the learning value of each cylinder and the condition of the learning completion flag are stored. In the O-region, the learning has not been completed yet. In 1-region, 2-region, 3-region and 4-region, the learning has been completed. The learning values of 1-region, 2-region, 3-region, and 4-region are denoted by "LRN1", "LRN2", "LRN3", and "LRN4", respectively. Moreover, center load of each region is denoted by "PM0", "PM1", "PM2", "PM3" and "PM4", respectively. The engine driving region can be divided with respect to other than engine load, such as engine speed, engine coolant temperature, intake air quantity, and required fuel injection quantity.

[Learning Value Reflecting Routine]

A learning value reflecting routine shown in FIG. 11 is a subroutine executed in step 406 of FIG. 9. In step 601, the computer computes a learning reflecting value based on the current engine driving condition. At this time, the learning value stored in each region is interpolated to obtain the learning reflecting value. Referring to FIG. 13, it will be described in detail.

In a case that the current engine load is denoted by "PMa", the learning reflecting value "FLRN" is computed according to a following formula (7).

$$FLRN=\frac{PM3-PMa}{PM3-PM2}\times LRN3+\frac{PMa-PM2}{PM3-PM2}\times LRN2 \tag{7}$$

Besides, in non-learning-executing region, the learning reflecting value may be computed by using of a learning value in adjacent learning-executing region. For example, in a case that the 0-region to 4-region are learning-executing regions and their outside regions are non-learning-executing regions, the learning reflecting values in non-learning-executing regions are computed based on the learning values in 0-region and 4-region.

Then, the procedure proceeds to step 602 in which the computed learning reflecting value is reflected on the final fuel injection quantity "TAU". Specifically, the final fuel injection quantity TAU is computed according to a following formula (8).

$$TAU=TP\times FAF\times FK\times FLRN\times FALL \tag{8}$$

wherein "TP" represents a basic fuel injection quantity, "FAF" represents an air-fuel ratio correction coefficient, "FK" represents a correction coefficient of each cylinder, "FLRN" represents a learning reflecting value, and "FALL" represents other correction coefficient.

As described above, according to the second embodiment, since the learning value is computed with respect to each cylinder and is stored in the backup memory, the cylinder-by-cylinder-air-fuel ratio control can be executed based on the learning value of each cylinder even if the estimated value of the air-fuel ratio is not obtained, whereby a air-fuel ratio variation can be reduced.

Furthermore, according to the second embodiment, since the learning value is computed with respect to each divided driving region and is stored in the backup memory, the cylinder-by-cylinder-air-fuel ratio control can be accurately executed even if the estimated value of the air-fuel ratio is not obtained.

Moreover, since the learning value is updated when the correction coefficient is not less than the specified value THA, an erroneous learning can be avoided.

Since the update value of the learning value is variably set according to the current correction coefficient, the learning can be completed in a short period even if the correction coefficient is relatively large. When the correction coefficient is relatively small, the learning value can be updated precisely.

According to the second embodiment, since the learning reflecting value is computed based on the learning value stored in the memory and this computed learning reflecting value is reflected on the air-fuel ratio control, the air-fuel ratio variation can be made smaller.

Figure 14:
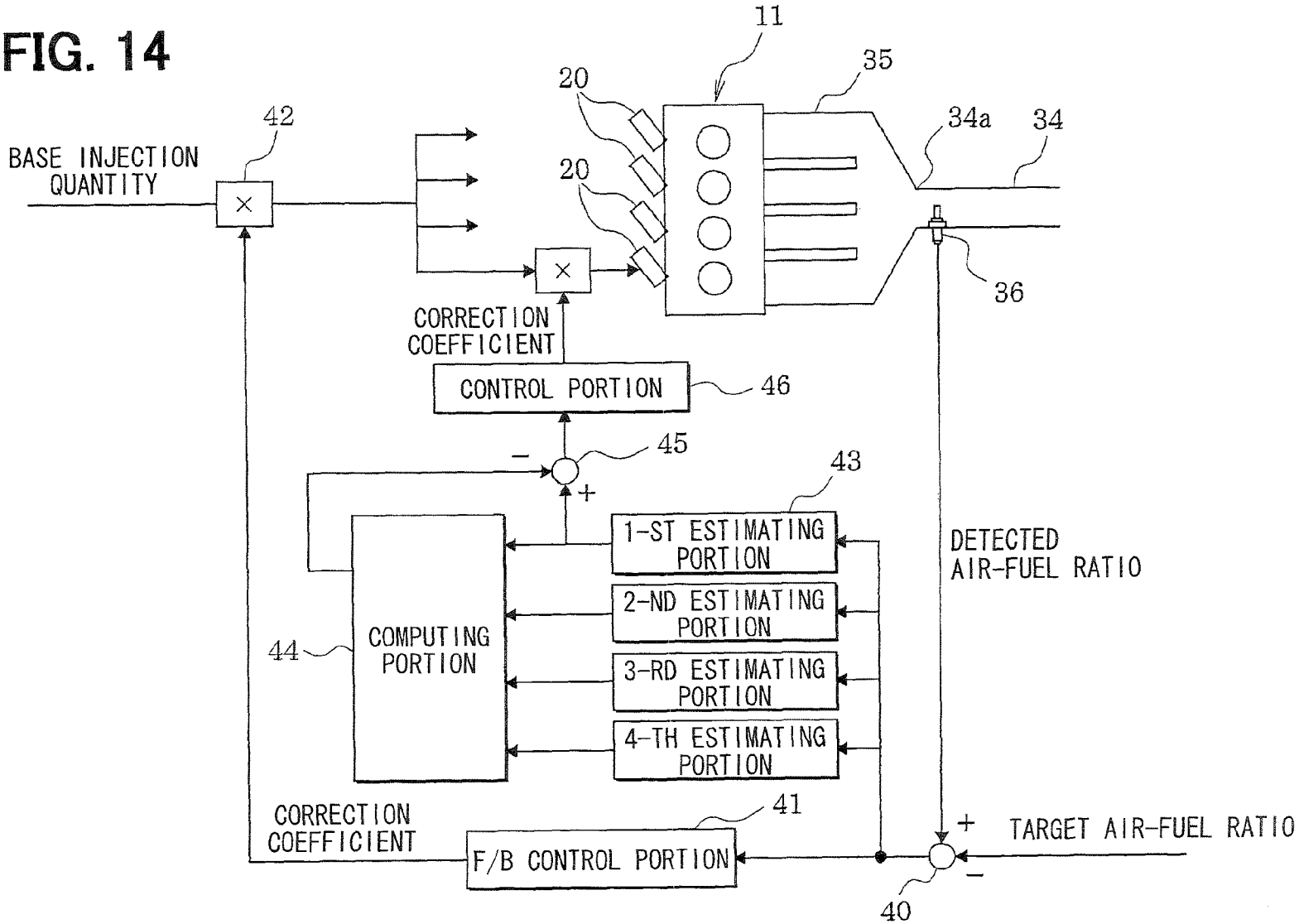
FIG. 14 is a schematic diagram illustrating a fuel injection quantity control system according to another embodiment.

As shown in FIG. 14, the air-fuel ratio estimating portion 43 may be provided to each cylinder of the engine, whereby the second exhaust system model can be established in view of an exhaust gas behavior. The model for estimating the air-fuel ratio of each cylinder can be independently established with respect to each cylinder, whereby the air-fuel ratio can be accurately estimated.

The first exhaust system model can be established with respect to multiple cylinders.

An oxygen sensor can be applied as the exhaust gas sensor.

The exhaust gas sensor may be arranged downstream of the catalyst or downstream of a turbine.

Based on the air-fuel ratio of each cylinder, an intake air quantity may be corrected.

The present invention is not limited to an intake port injection engine. The present invention can be applied to a direct injection engine or a dual injection engine.

The present invention can be applied to any other type multi-cylinder engine.

What is claimed is:

1. A controller for an internal combustion engine, comprising an air-fuel ratio estimating portion which performs a cylinder-by-cylinder air-fuel ratio estimation based on a detection value of an exhaust gas sensor arranged in a confluent portion of an exhaust gas flowed from multiple cylinders, wherein:

the air-fuel ratio estimating portion defines:

a first exhaust system model which outputs an air-fuel ratio at the confluent portion based on an air-fuel ratio in a cylinder; and a second exhaust system model which outputs the detection value of the exhaust gas sensor based on the air-fuel ratio at the confluent portion, the air-fuel ratio estimating portion includes:

a confluent-portion-air-fuel ratio estimating portion which estimates the air-fuel ratio at the confluent portion based on the detection value of the exhaust gas sensor and the second exhaust system model; and a combust-air-fuel ratio estimating portion which estimates a combust-air-fuel ratio of each cylinder based on the air-fuel ratio at the confluent portion and the first exhaust system model.

2. A controller for an internal combustion engine according to claim 1, wherein:

the first exhaust system model is established in such a manner as to output the air-fuel ratio at the confluent portion in view of a difference in detectability of the air-fuel ratio sensor with respect to each cylinder.

3. A controller for an internal combustion engine according to claim 1, wherein:

the second exhaust system model outputs the detection value of the air-fuel ratio sensor by adding a history of the air-fuel ratio at the confluent portion to a history of the detection value of the air-fuel ratio sensor; and the histories are multiplied by a specified weight.

4. A controller for an internal combustion engine according to claim 1, wherein:

the confluent-portion-air-fuel ratio estimating portion estimates the air-fuel ratio at the confluent portion by an observer based on the second exhaust system model.

5. A controller for an internal combustion engine according to claim 1, wherein:

the combust-air-fuel ratio estimating portion estimates the combust-air-fuel ratio of each cylinder by an inverse model of the first exhaust system model.

6. A controller for an internal combustion engine according to claim 1, wherein:

the air-fuel ratio estimating portion establishes the first exhaust system model according to an engine driving condition and modifies the confluent-portion-air-fuel ratio estimating portion according to an engine driving condition.

7. A controller for an internal combustion engine according to claim 1, wherein:

the air-fuel ratio estimating portion defines: the first exhaust system model according to a response characteristic of the exhaust gas sensor and modifies the confluent-portion-air-fuel ratio estimating portion according to the response characteristic of the exhaust gas sensor.

8. A controller for an internal combustion engine according to claim 1, further comprising:

an estimation-accuracy determination portion which determines an estimation accuracy of the combust-air-fuel ratio by the combust-air-fuel ratio estimating portion, wherein:

the air-fuel ratio estimating portion varies an internal parameter of at least one of the confluent-portion-air-fuel ratio estimating portion and the combust-air-fuel ratio estimating portion, based on a determination result of the estimation-accuracy determination portion.

9. A controller for an internal combustion engine according to claim 1, wherein:

the confluent-portion-air-fuel ratio estimating portion estimates the air-fuel ratio at the confluent portion based on the detection value of the exhaust gas sensor when a crank angle of the engine is at a reference crank angle; and the air-fuel ratio estimating portion determines the reference crank angle based on at least a load of the engine.

10. A controller for an internal combustion engine according to claim 1, wherein:

the combust-air-fuel ratio estimating portion estimates the combust-air-fuel ratio of each cylinder based on the air-fuel ratio at the confluent portion when a crank angle of the engine is at a reference crank angle; and the air-fuel ratio estimating portion determines the reference crank angle based on at least a load of the engine.

11. A controller for an internal combustion engine according to claim 9, wherein:

the air-fuel ratio estimating portion corrects the reference crank angle according to a valve closing timing of an exhaust valve.

12. A controller for an internal combustion engine according to claim 1, wherein:

the air-fuel ratio estimating portion determines whether an execution condition for air-fuel ratio estimation is established according to at least one of a condition of the exhaust gas sensor and a driving condition of the engine.

13. A controller for an internal combustion engine according to claim 12, wherein:

the execution condition for air-fuel ratio estimation includes a condition in which no fuel-cut is conducted and a specified time period has elapsed after a fuel-cut is conducted.

14. A controller for an internal combustion engine according to claim 1, wherein:

the air-fuel ratio estimating portion is provided to each cylinder.

15. A controller for an internal combustion engine according to claim 1, further comprising:

an air-fuel ratio feedback control portion which controls the air-fuel ratio of each cylinder so that each air-fuel ratio agrees with a target value; and an air-fuel ratio control portion which computes an air-fuel ratio variation between cylinders based on the estimated air-fuel ratio estimated by the air-fuel ratio estimating portion, the air-fuel ratio control portion which computes a correction value for each cylinder based on the air-fuel ratio variation, the air-fuel ratio control portion which executes an air-fuel ratio control in which an air-fuel ratio control quantity is corrected based on the correction value.

16. A controller for an internal combustion engine according to claim 15, wherein:

the air-fuel ratio control portion computes the air-fuel ratio variation based on a difference between the estimated air-fuel ratio of each cylinder and an average of the estimated air-fuel ratios.

17. A controller for an internal combustion engine according to claim 15, wherein:

the air-fuel ratio control portion computes an average of the correction values of all cylinders and corrects the correction value of each cylinder based on the average of the correction values.

18. A controller for an internal combustion engine according to claim 15, wherein:

the air-fuel ratio control portion executes an air-fuel ratio control when the air-fuel ratio estimation is permitted under a specified condition.

19. A controller for an internal combustion engine according to claim 1, wherein:

an air-fuel ratio feedback control portion which controls the air-fuel ratio of each cylinder so that each air-fuel ratio agrees with a target value; and a feedback gain variation portion which computes an air-fuel ratio variation between cylinders based on the estimated air-fuel ratio estimated by the air-fuel ratio estimating portion, and varies a feedback gain of an air-fuel ratio feedback control based on the air-fuel ratio variation.

20. A controller for an internal combustion engine according to claim 15, further comprising:

a learning portion which computes a learning value of each cylinder based on the correction value and stores the learning value in a backup memory.

21. A controller for an internal combustion engine according to claim 20, wherein:

a learning portion divides a driving region of the engine into multiple regions and stores the learning value in each region.

22. A controller for an internal combustion engine according to claim 20, wherein:

the learning portion updates the learning value only when the correction value is not less than a specified value.

23. A controller for an internal combustion engine according to claim 22, wherein:

the specified value is defined in such a manner that a difference between an average of the air-fuel ratios and each air-fuel ratio corresponds to a value in which an excess air factor is not less than 0.01.

24. A controller for an internal combustion engine according to claim 22, wherein:

the learning portion determines an update value of the learning value according to the current correction value.

25. A controller for an internal combustion engine according to claim 22, wherein:

the learning portion defines an update cycle of the learning value longer than a computing cycle of the correction value.

26. A controller for an internal combustion engine according to claim 20, further comprising:

a learning-value-reflecting portion which reflects the learning value stored in the memory on the air-fuel ratio control.

27. A controller for an internal combustion engine according to claim 26, wherein:

the learning portion defines the driving region of the engine as a learning executing region and non-learning-executing region; and a learning-value-reflecting portion reflects the learning value in the learning executing region adjacent to a non-learning-executing reign on the air-fuel ratio control in the non-learning-executing region.

28. A controller for an internal combustion engine according to claim 20, wherein:

the learning value is prohibited to be updated when an executing condition for the air-fuel ratio control is not established.

29. A controller for an internal combustion engine according to claim 20, wherein:

the learning value is prohibited to be updated when a variation in detection value of the exhaust gas sensor exceeds a specified level.

30. A controller for an internal combustion engine according to claim 15, wherein:

the air-fuel ratio control portion computes the correction value at a specified reference crank angle and determines the reference crank angle according to a load of the engine.

* * * * *